US010543994B2

(12) United States Patent
Yazawa

(10) Patent No.: US 10,543,994 B2
(45) Date of Patent: Jan. 28, 2020

(54) STACKING APPARATUS, FEEDING APPARATUS, AND IMAGE FORMING APPARATUS

(71) Applicant: CANON FINETECH NISCA INC., Misato-shi (JP)

(72) Inventor: Hiroshi Yazawa, Kai (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/982,283

(22) Filed: May 17, 2018

(65) Prior Publication Data

US 2018/0354738 A1 Dec. 13, 2018

(30) Foreign Application Priority Data

Jun. 9, 2017 (JP) ..... 2017-114522

(51) Int. Cl.
*B65H 1/28* (2006.01)

(52) U.S. Cl.
CPC ..... *B65H 1/28* (2013.01); *B65H 2405/15* (2013.01); *B65H 2405/331* (2013.01); *B65H 2701/11312* (2013.01)

(58) Field of Classification Search
CPC ..... B65H 1/28; B65H 1/14; B65H 2405/331; B65H 2405/3311
USPC ..... 271/9.12
See application file for complete search history.

(56) References Cited

U.S. PATENT DOCUMENTS 5,971,387 A * 10/1999 Kita ..... B65H 1/26 271/147
6,123,329 A * 9/2000 Sato ..... B65H 1/14 271/145
8,480,073 B1 * 7/2013 Ishikawa ..... B65H 1/14 271/126
9,815,643 B2 * 11/2017 Tanisaki ..... G03G 15/6508
2011/0049798 A1 3/2011 Yamaguchi
2015/0130124 A1 * 5/2015 Muto ..... B65H 7/04 271/9.03
2016/0121633 A1 * 5/2016 Tanisaki ..... G03G 15/6508 271/9.01
2018/0267453 A1 * 9/2018 Yazawa ..... G03G 15/6502
2019/0002218 A1 * 1/2019 Shimura ..... B65H 1/08
2019/0062081 A1 * 2/2019 Yazawa ..... B65H 1/28

FOREIGN PATENT DOCUMENTS

JP 2003-063719 A 3/2003

OTHER PUBLICATIONS

Extended European Search Report dated Nov. 12, 2018, in European Patent Application No. 18174005.1.

* cited by examiner

*Primary Examiner* — Michael C McCullough
(74) *Attorney, Agent, or Firm* — Venable LLP

(57) ABSTRACT

A stacking apparatus includes a first stacking unit, for stacking sheets of a first size, configured to move vertically between an upper limit position and a lower limit position, and a second stacking unit for stacking sheets of a second size larger than the first size in cooperation with the first stacking unit. The second stacking unit is jointed to the first stacking unit at a predetermined position, moving vertically together with the first stacking unit while being joined to the first stacking unit above the predetermined position, and is released from being jointed to the first stacking unit below the predetermined position.

18 Claims, 8 Drawing Sheets

STACKING APPARATUS, FEEDING APPARATUS, AND IMAGE FORMING APPARATUS

BACKGROUND OF THE INVENTION

Field of the Invention

The present invention relates to a stacking apparatus, a feeding apparatus, and an image forming apparatus.

Description of the Related Art

Japanese Patent Laid-Open No. 2003-63719 describes the structure of a sheet feeding apparatus that includes two stacking units capable of stacking sheets and a partition plate arranged between them. According to Japanese Patent Laid-Open No. 2003-63719, sheets of the same size (8.5×11 size (unit: inch) in Japanese Patent Laid-Open No. 2003-63719) can be stacked on the two stacking units. Then, by removing the partition plate, it becomes possible to use these two stacking units integrally and to stack sheets of a large size (11×17 size (unit: inch) in Japanese Patent Laid-Open No. 2003-63719).

According to the structure in Japanese Patent Laid-Open No. 2003-63719, driving units (for example, power sources such as motors or transmission mechanisms for transmitting their driving forces) for controlling up-and-down movements of the two stacking units need to be provided in the two stacking units, respectively. Furthermore, when a plurality of motors are provided, a stacking plate needs to be moved up and down by synchronizing the respective motors, complicating the control.

SUMMARY OF THE INVENTION

The present invention implements, in a stacking apparatus that stacks sheets of a plurality of sizes on a plurality of stacking units, a stacking apparatus capable of synchronizing the respective stacking units with a simple arrangement.

One of the aspects of the present invention provides a stacking apparatus, comprising a first stacking unit configured to move up and down between an upper limit position capable of rising and a lower limit position capable of lowering, and configured to stack sheets of a first size, and a second stacking unit configured to be jointed to the first stacking unit at a predetermined position in an up-and-down movement direction of the first stacking unit, the second stacking unit being moved up and down together with the first stacking unit while being jointed to the first stacking unit in a case where the first stacking unit is located between the predetermined position and the upper limit position, and being released from a joint to the first stacking unit in a case where the first stacking unit is located below the predetermined position, wherein the second stacking unit is configured to stack sheets of a second size larger than the first size in cooperation with the first stacking unit in the range from the predetermined position to the upper limit position.

Further features of the present invention will become apparent from the following description of exemplary embodiments with reference to the attached drawings.

DESCRIPTION OF THE EMBODIMENTS

Figure 1:
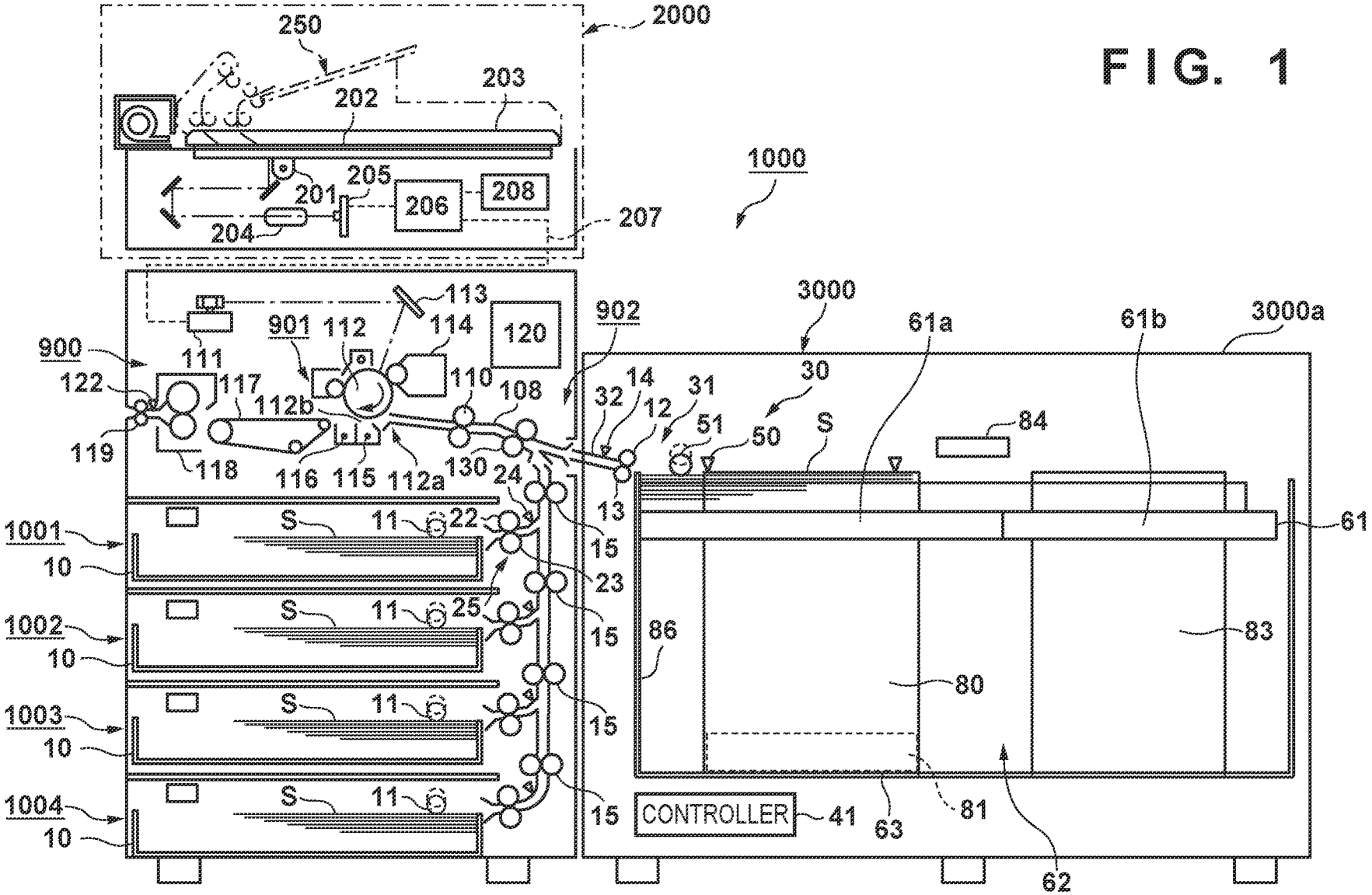
FIG. 1 is a schematic view for explaining an example of the structure of a printer.

A preferred embodiment of the present invention will be described below with reference to the accompanying drawings. Note that the drawings are schematic views illustrated for the purpose of only explaining structures or arrangements, and the sizes of illustrated members do not always reflect actual sizes. In addition, the same reference numerals denote the same members or same constituent elements throughout the drawings, and a description of repetitive contents will be omitted hereinafter.

FIG. 1 is a schematic view for explaining the system arrangement of a printer 1000 according to an embodiment. The printer 1000 adopts an arrangement of an electrophotographic method in this arrangement but may adopt another arrangement of an inkjet method or the like.

The concept of a printer includes not only a printer that includes image formation or printing on a sheet as a main function but also a printer that includes this as an auxiliary function (for example, a multi-function printer or the like that further has a scanner function, a facsimile function, and the like). Therefore, the "printer" may be referred to as an image forming apparatus or an image forming system, or may be referred to as a printing apparatus or a printing system.

In this embodiment, the printer 1000 includes an apparatus main body 900, a scanner (reading apparatus) 2000, and a paper deck (feeding apparatus or sheet feeding apparatus) 3000. The apparatus main body 900 includes respective mechanisms for performing image formation and forms (prints) an image on each sheet S. The scanner 2000 reads an image on each sheet S, generates data according to the image (image data), and outputs the generated data to the apparatus main body 900. The paper deck 3000 is configured to be compatible with the sheets S of a plurality of sizes, can selectively store one of various kinds of sheets, and also feeds (or outputs) the sheet S of a target size to the apparatus main body 900, the details of which are to be described later.

For example, based on the image data from the scanner 2000, the apparatus main body 900 performs printing on the sheets S received from the paper deck 3000 or performs printing on the sheets S in the apparatus main body 900, and then discharges the printed sheets S. Moreover, the apparatus main body 900 can also communicate with a general-purpose computer by wired communication (such as a LAN) or wireless communication (such as Wi-Fi) and perform printing based on resulting input image data.

In this specification, the concept of an image includes not only visually recognizable information such as a character, symbol, pattern, figure, picture, and photograph, but also includes a blank (a region which is practically the same as the base color of the paper surface). A sheet can be any printing medium capable of forming and printing an image, and paper of a predetermined size complying with a standard such as A3 or A4 is generally used. However, paper of a non-standard size may be used.

The apparatus main body 900 includes an image forming unit 901, a sheet conveyance mechanism 902, a plurality of feeders 1001 to 1004, and a controller 120. The image forming unit 901 forms an image on each sheet S conveyed by the sheet conveyance mechanism 902. A mode in which the sheet conveyance mechanism 902 conveys the sheet S from the paper deck 3000 to the image forming unit 901 in the embodiment to be described later will be described. However, the sheet conveyance mechanism 902 can also convey the sheets S from the feeders 1001 to 1004 to the image forming unit 901.

The controller 120 controls the operation of each element in the apparatus main body 900 so that printing in the apparatus main body 900 is implemented appropriately. For example, the controller 120 may be configured to be able to implement a predetermined program by using a CPU (Central Processing Unit) and a memory, or may be implemented by a semiconductor device such as a PLD (Programmable Logic Device) or an ASIC (Application Specific Integrated Circuit). That is, control by the controller 120 can be implemented by either hardware or software.

The image forming unit 901 includes a laser beam scanning unit 111, a photosensitive drum 112, a mirror 113, a developing unit 114, a transfer charger 115, a separation charger 116, a conveyance belt 117, a fixing unit 118, discharge rollers 119, and a discharge sensor 122. The laser beam scanning unit 111 outputs a laser beam based on image data from the scanner 2000. This laser beam is reflected by the mirror 113 and output from the laser beam scanning unit 111 such that reflected light from the mirror 113 scans the surface of the photosensitive drum 112. Consequently, a potential distribution is formed as a latent image on the surface of the photosensitive drum 112.

The developing unit 114 applies toner to the surface of the photosensitive drum 112 and performs development based on the above-described potential distribution. Note that the sheet conveyance mechanism 902 to be described later conveys each sheet S to a position 112*a* below the photosensitive drum 112. The transfer charger 115 transfers the toner on the surface of the photosensitive drum 112 to this sheet S in a transfer portion 112*b*. Consequently, an image is formed on the sheet S. This sheet S is separated from the photosensitive drum 112 by the separation charger 116, and then conveyed to the fixing unit 118 by the conveyance belt 117. The fixing unit 118 fixes the transferred toner to the sheet S. Subsequently, the discharge rollers 119 discharge this sheet S outside the apparatus main body 900. The discharge sensor 122 detects that the sheet S is discharged and outputs, for example, a signal indicating the completion of printing on one sheet to the controller 120.

The sheet conveyance mechanism 902 includes pickup rollers 11, conveyance roller pairs 15, roller pairs 25 each being made up of a feed roller 22 and a retard roller 23, detection sensors 24, a sheet conveyance path 108, a preregistration roller pair 130, and a registration roller pair 110. Note that in a description below, a downstream side according to a conveyance direction (or a feeding direction) may simply be expressed as a downstream side, and a side opposite to this may simply be expressed as an upstream side.

Each pickup roller 11 is arranged in a corresponding one of the feeders 1001 to 1004, takes out the sheets S one by one from the corresponding feeder (1001 or the like), and conveys each sheet to the downstream side. Each roller pair 25 is arranged in a corresponding one of the feeders 1001 to 1004, conveys the sheets S taken out from the corresponding feeder one by one with the feed roller 22 and the retard roller 23, and if two or more sheets S are taken out, separates them from each other. More specifically, if one sheet S is taken out, the feed roller 22 and the retard roller 23 rotate in a direction of conveying the sheet S to the downstream side. If the two or more sheets S are taken out, the retard roller 23 rotates backward, and separates the two or more sheets S to convey one sheet S to the downstream side and return the sheets S other than this to the corresponding feeder.

Each detection sensor 24 is arranged in a corresponding one of the feeders 1001 to 1004 and outputs a signal indicating passage of the sheet S to the controller 120. The conveyance roller pairs 15 are arranged in respective positions of the sheet conveyance path 108 and convey the sheet S from each of the feeders 1001 to 1004 to the downstream side.

The preregistration roller pair 130 conveys each sheet S from one of the feeders 1001 to 1004 or each sheet S from the paper deck 3000 to be described later to the downstream side. Then, the registration roller pair 110 conveys this sheet S to the image forming unit 901 in synchronism with a print start timing by the image forming unit 901.

Each paper feed cassette 10 is arranged in a corresponding one of the feeders 1001 to 1004, allowing a user to store the sheets S of a corresponding size in the paper feed cassette 10. Note that the sheets S of the same size may be stored in the feeders 1001 to 1004, or the sheets S of different sizes may be stored in some/all of them.

The scanner 2000 includes a scanning light source 201, a platen glass 202, a pressing plate 203, a lens 204, a light-receiving element 205, a processor 206, a communication cable 207, a memory 208, and an auto document feeder 250. The scanning light source 201 irradiates, with light, an original (paper on which some image is formed, for example, a cutout from a magazine or the like) arranged on the platen glass 202 by the user and pressed by the pressing plate 203. Irradiation is performed such that this light scans the surface of the original.

In this embodiment, reflected light from the original is guided by a mirror, condensed by the lens 204, and then detected by the light-receiving element 205, as shown in FIG. 1. Based on a detection result by the light-receiving element 205, the processor 206 generates image data based on the image on the original. The processor 206 can output this image data to the apparatus main body 900 via the communication cable 207 or store the data in the memory 208.

If the user places one or more originals, the auto document feeder 250 is configured to capture them one by one in the scanner 2000. Consequently, the processor 206 generates image data based on the image on each original in accordance with the same procedure as described above.

Note that the arrangement of each of the apparatus main body 900 and the scanner 2000 is merely an example, and the printer 1000 is not limited to the above-described arrangement.

The paper deck 3000 is connected to the apparatus main body 900 so as to be able to supply the sheet S and includes, in this embodiment, a paper feed mechanism 30, a controller 41, and a housing 3000*a* that incorporates them. In this embodiment, the paper feed mechanism 30 includes a stacking mechanism 61 (stacking apparatus) configured to be able to stack the sheets S of various sizes and a storage 62 that stores the sheets S with the stacking mechanism 61.

The stacking mechanism 61 includes a first stacking unit 61*a* serving as a main lifter and a second stacking unit 61*b* serving as an extension lifter. The second stacking unit 61*b* is arranged to be jointed to the first stacking unit 61*a*, the details of which are to be described later. For example, it is possible to stack the sheets S of a normal size (first size) by using the first stacking unit 61*a*. It is also possible to stack the sheets S of a large size (second size) by jointing the first stacking unit 61*a* and the second stacking unit 61*b* to each other to use the first and second stacking units 61*a* and 61*b* in common. FIG. 1 shows a mode in which the sheets S of the large size are stacked by using both the first and second stacking units 61*a* and 61*b* in the paper deck 3000. A buffer member 81 may be arranged at a position to be the lower end of a movable region of the first stacking unit 61*a* on a base plate 63 of the storage 62.

Note that the sizes of the above-described sheets S may be expressed by the normal size/large size in order to facilitate the explanation in this specification. However, these merely indicate relative dimensions based on a use form of the stacking mechanism 61. For example, the large size is an elongated size having a length (a length in the conveyance direction) of about 1.5 to 3 times longer than the normal size and can be used for, for example, an A4 two-page or four-page spread of a catalogue, pamphlet, POP (Point of Purchase) advertising, book jacket, or the like.

The sheets S on the stacking mechanism 61 are pressed by a pressurization unit 84, making it possible to suppress floating of the stacked sheets S. An uppermost sheet out of the stacked sheets S is taken out by a pickup roller 51, and conveyed by a roller pair 31 made up of a feed roller 12 and a retard roller 13 to a connecting conveyance path 32. The connecting conveyance path 32 is connected to the sheet conveyance path 108 in the apparatus main body 900. Consequently, the sheet S conveyed to the connecting conveyance path 32 is conveyed to the sheet conveyance path 108, and then conveyed to the image forming unit 901 by the preregistration roller pair 130 and the registration roller pair 110. From this viewpoint, the connecting conveyance path 32 corresponds to an output unit that outputs the sheet S to the apparatus main body 900.

Note that the function of the pickup roller 51 is the same as that of each pickup roller 11. Further, the functions of the feed roller 12 and retard roller 13 are, respectively, the same as those of feed rollers 22 and retard rollers 23 of the roller pair 31.

Figure 2:
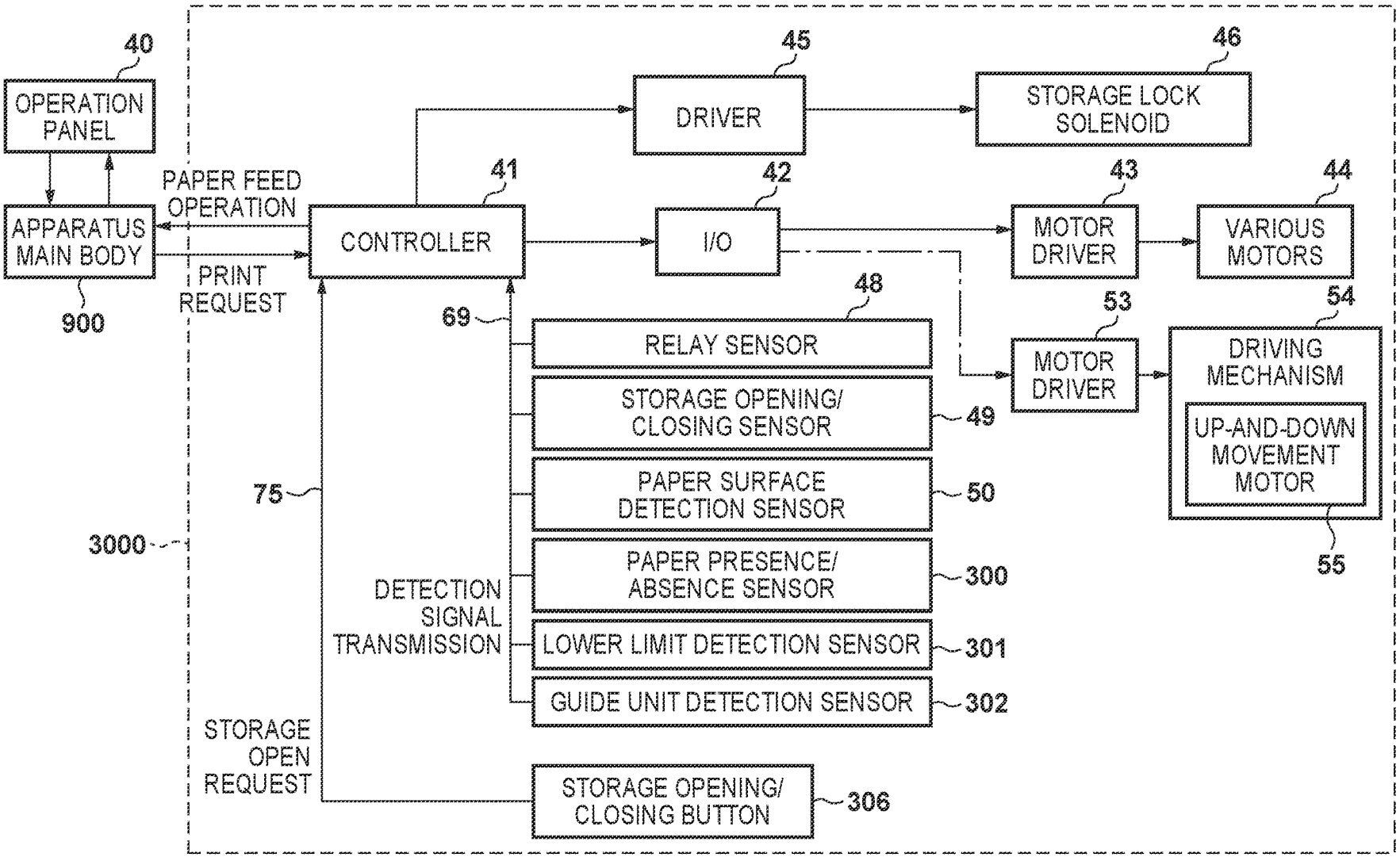
FIG. 2 is a block diagram for explaining an example of a system arrangement of a paper deck.

FIG. 2 is a block diagram for explaining the details of the system arrangement of the paper deck 3000. The paper deck 3000 includes a driver 45 and a storage lock solenoid 46. The storage 62 can be locked by a solenoid lock method. The controller 41 drives the storage lock solenoid 46 by the driver 45, locking the storage 62 (restricting opening of the storage 62) or releasing the lock (making it possible to open the storage 62).

The paper deck 3000 further includes an I/O interface 42, a motor driver 43, various motors 44, a motor driver 53, and a driving mechanism 54. These are arranged in the paper feed mechanism 30. The controller 41 drives the various motors 44 by, for example, the motor driver 43 via the I/O interface 42, rotating the pickup roller 51.

The controller 41 also drives, for example, the motor driver 53 via the I/O interface 42, driving the driving mechanism 54. The driving mechanism 54 includes an up-and-down movement motor 55 or the like serving as a power source and functions as an up-and-down movement driving unit that moves up and down the first stacking unit 61*a* serving as the main lifter in a vertical direction, the details of which are to be described later. With this arrangement, the controller 41 drives the up-and-down movement motor 55 by using the motor driver 53, and controls up-and-down movement of the first stacking unit 61*a*.

The paper deck 3000 further includes a storage opening/closing button 306. If the user presses the storage opening/closing button 306 in an operation state in which opening of the storage 62 is permitted (for example, a state in which printing is not performed in the apparatus main body 900), a signal 75 indicating that there is an open request of the storage 62 is input to the controller 41. In response to this, the controller 41 drives the storage lock solenoid 46 by the driver 45 to release the lock of the storage 62 and open the storage 62.

The paper deck 3000 further includes a plurality of sensors 48 to 50 and 300 to 302. Detection results of these sensors 48 to 50 and 300 to 302 are input to the controller 41 by signals 69 indicating the detection results. In response to this, the controller 41 mainly controls the operation of each element of the paper feed mechanism 30 in the paper deck 3000.

The relay sensor 48 is one of sensors for detecting the position of the first stacking unit 61*a* and is a sensor for moving the first stacking unit 61*a* to a position where the user replenishes the sheets S easily when the storage 62 is opened. The storage opening/closing sensor 49 is a sensor for detecting whether the storage 62 is set in an open state or a closed state. The paper surface detection sensor 50 is a sensor for detecting the uppermost position of the sheets S stacked on the stacking mechanism 61.

The paper presence/absence sensor 300 is a sensor for detecting the presence/absence of the sheets S on the stacking mechanism 61. The lower limit detection sensor 301 is a sensor for detecting whether the first stacking unit 61*a* is located at the lower end of the movable region. The guide unit detection sensor 302 is a sensor for detecting the size of each sheet S, the details of which are to be described later.

With the above arrangement, the controller 41 controls the operation of each element in the paper feed mechanism 30 so that paper feed by the paper feed mechanism 30 is implemented appropriately. Similarly to the controller 120, control by the controller 41 can be implemented by either hardware or software.

The paper deck 3000 can perform signal communication with the apparatus main body 900 by the controller 41 and can, for example, accept a paper feed request from the apparatus main body 900 and establish synchronization for a print start timing, a paper feed timing, or the like. The apparatus main body 900 accepts a print job from the user via an operation panel 40. The apparatus main body 900 can also notify the user of information (for example, a need to replenish the sheets S, a need to exchange toner, occurrence of paper jam, or the like) needed for printing via the operation panel 40. Note that the operation panel 40 can be provided at a position easily viewable by the user, for example, in the upper portion of the apparatus main body 900.

Figure 3:
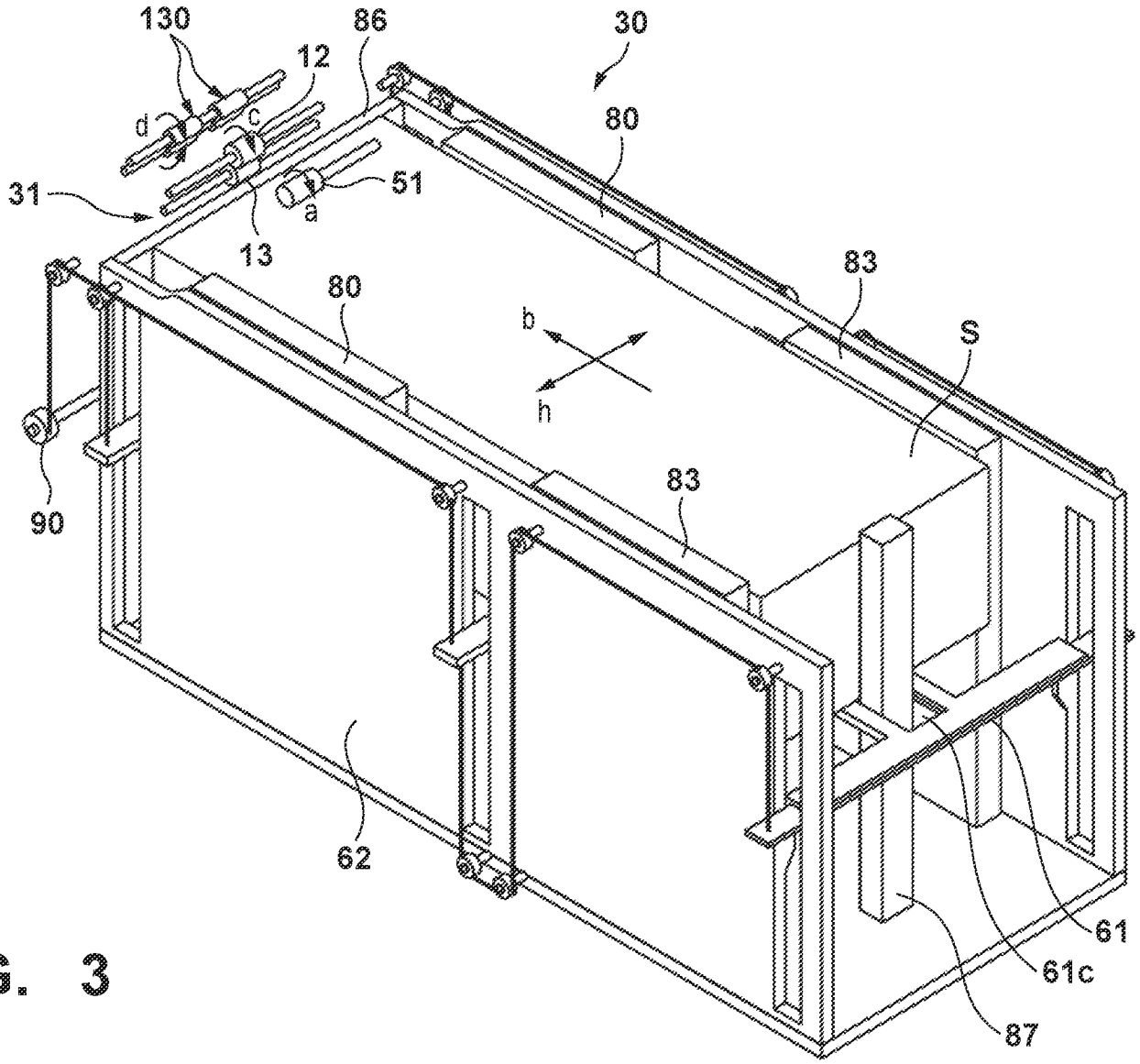
FIG. 3 is a perspective view for explaining an example of the internal structure of the paper deck.

FIG. 3 is a perspective view showing the internal structure, or mainly the paper feed mechanism 30 of the paper deck 3000. When the pickup roller 51 rotates in an a direction, the uppermost sheet S stacked on the stacking mechanism 61 is taken out in a b direction, starting conveyance of the sheet S. The sheet S is conveyed to the connecting conveyance path 32 by rotating the feed roller 12 in a c direction and further conveyed to the downstream side by rotating the preregistration roller pair 130 in a d direction.

The paper feed mechanism 30 further includes a leading end guide unit 86 on one-end side, that is, the downstream side in the b direction and still further includes a trailing end guide unit (first guide unit) 87 on the other-end side, that is, the upstream side. The leading end guide unit 86 is a plate member that forms the side surface portion of the storage 62. The trailing end guide unit 87 is a columnar member arranged such that its position can be adjusted in the b direction. With these guide units 86 and 87, it is possible to guide a sheet length or align a bundle of the sheets S stacked on the stacking mechanism 61.

Let an h direction be a direction crossing (here, substantially perpendicular to) the b direction. The paper feed mechanism 30 further includes side edge guide units (second guide units) 80 and 83 on both sides in the h direction. A pair of side edge guide units 80 is arranged so as to sandwich the sheets S from lateral sides on the downstream side. Similarly, a pair of side edge guide units 83 are arranged on the upstream side. The side edge guide units 80 and 83 are arranged such that their positions can be adjusted in the h direction. That is, the side edge guide units 80 can move a part of a stacking region of the sheets S by the first stacking unit 61*a* in the h direction, and the side edge guide units 83 can move a part of a stacking region of the sheets S by the second stacking unit 61*b* in the h direction. This makes it possible to guide a sheet width or align the bundle of the sheets S stacked on the stacking mechanism 61.

The side edge guide units 80 and 83 may be referred to as width guide units, sheet width guide units, or the like. Movable ranges of the side edge guide units 80 and 83 in the h direction may be changed based on the position of the trailing end guide unit 87 in the b direction. For example, if the sheets S of the normal size are stacked, the trailing end guide unit 87 is located on the downstream side of the pair of side edge guide units 83, and the pair of these side edge guide units 83 can move to a position where they come close to each other.

The respective guide units 80, 83, 86, and 87 described above may collectively be expressed as a guide mechanism, a guide member, or the like.

Figure 4:
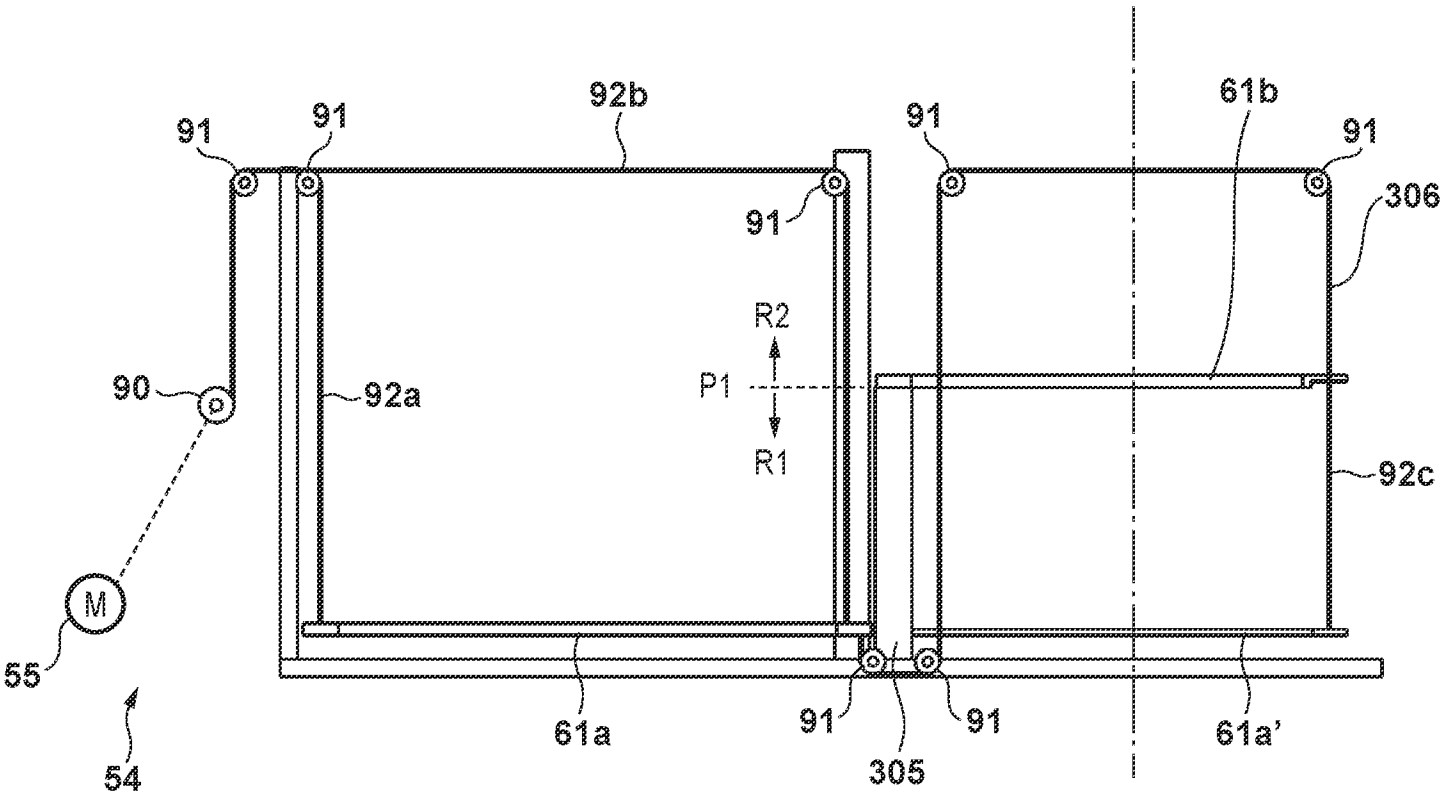
FIG. 4 is a side view for explaining an example of the internal structure of the paper deck.

FIG. 4 is a side view showing the paper feed mechanism 30. A state in which the sheets S are not stacked is shown here in order to explain the structure of the stacking mechanism 61 in detail. As described above, the stacking mechanism 61 includes the first stacking unit 61*a* serving as the main lifter and the second stacking unit 61*b* serving as the extension lifter. FIG. 4 shows a state in which the first stacking unit 61*a* is located at the lower end of its movable region.

The first stacking unit 61*a* includes a thin portion 61*a*' on the upstream side. The second stacking unit 61*b* is arranged to be jointed to the first stacking unit 61*a* by overlapping the portion 61*a*' (the first and second stacking units 61*a* and 61*b* are arranged to be jointed to each other). That is, the portion 61*a*' functions as a joint unit that implements a joint to the second stacking unit 61*b*.

Then, the second stacking unit 61*b* is fixed to a position at a predetermined height from the base plate 63, or here a position (first position) P1 above the base plate 63 by a predetermined distance by being supported by a support unit 305 in a state in which it is not jointed to the first stacking unit 61*a*.

As shown in FIG. 4, the driving mechanism 54 (see FIG. 2) further includes a driving pulley 90, a plurality of guide pulleys 91, and a plurality of wires 92*a* to 92*c* (lifting members), in addition to the up-and-down movement motor 55. The driving pulley 90 is arranged to be coaxial with the rotation shaft of the up-and-down movement motor 55. The plurality of guide pulleys 91 are arranged so as to guide the wires 92*a* to 92*c* to respective positions capable of fixing the first stacking unit 61*a*. The wire 92*a* is fixed to the downstream-side edge portion of the first stacking unit 61*a*. The wire 92*b* is fixed to the central portion of the first stacking unit 61*a*. The wire 92*c* is fixed to the upstream-side edge portion of the first stacking unit 61*a* (the thin portion 61*a*' thereof).

The driving pulley 90 rotates when the up-and-down movement motor 55 rotates, and the rotation is transmitted to the first stacking unit 61*a* via the respective wires 92*a* to 92*c*. With this arrangement, the driving force of the up-and-down movement motor 55 is transmitted to the first stacking unit 61*a* directly/indirectly and, for example, the first stacking unit 61*a* is raised when the up-and-down movement motor 55 rotates in one direction, and the first stacking unit 61*a* is lowered when the up-and-down movement motor 55 rotates in the other direction.

The wires 92*a* to 92*c* are, respectively, fixed to the downstream-side edge portion, central portion, and upstream-side edge portion of the first stacking unit 61*a*, making it possible to move up and down the first stacking unit 61*a* while maintaining its orientation horizontal and suppressing its distortion. The first stacking unit 61*a* is configured to support the second stacking unit 61*b* if the second stacking unit 61*b* is jointed, the details of which are to be described later. Accordingly, if the first stacking unit 61*a* is fixed at a plurality of positions by the wire 92*a* and the like as in this embodiment, these fixing positions preferably include at least two points on an upstream side and a downstream side with respect to the barycenter of the second stacking unit 61*b* in the b direction. Here, the barycenter of the second stacking unit 61*b* is indicated by an alternate long and short dashed line in FIG. 4. Note that as can also be seen in the perspective view of FIG. 3, the driving pulleys 90, the plurality of guide pulleys 91, and the wires 92*a* to 92*c* described above are provided on the both sides in the h direction.

The wires 92*a* to 92*c* can be anything capable of transmitting the driving force of the up-and-down movement motor 55. Instead of wires, other string-like, belt-like, or chain-like transmission members, for example, cables, belts, chains, or the like may be used for these.

Figure 5A:
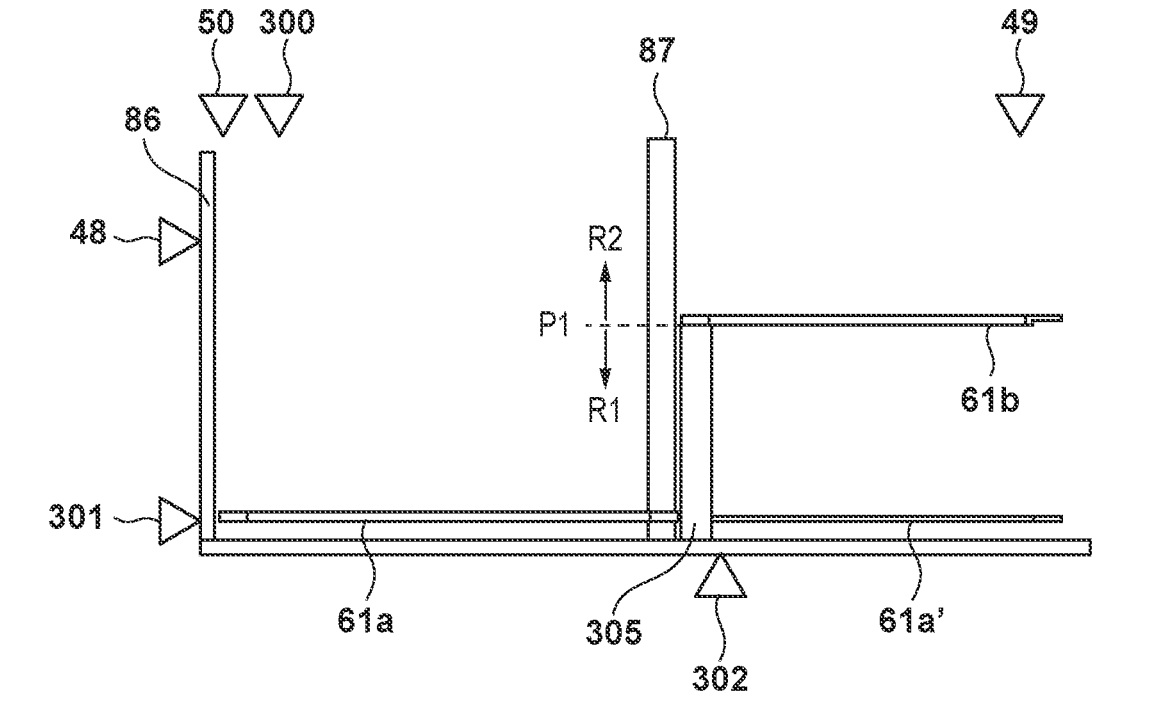
FIGS. 5A and 5B are side views each for explaining the behavior of a stacking mechanism.
Figure 5B:
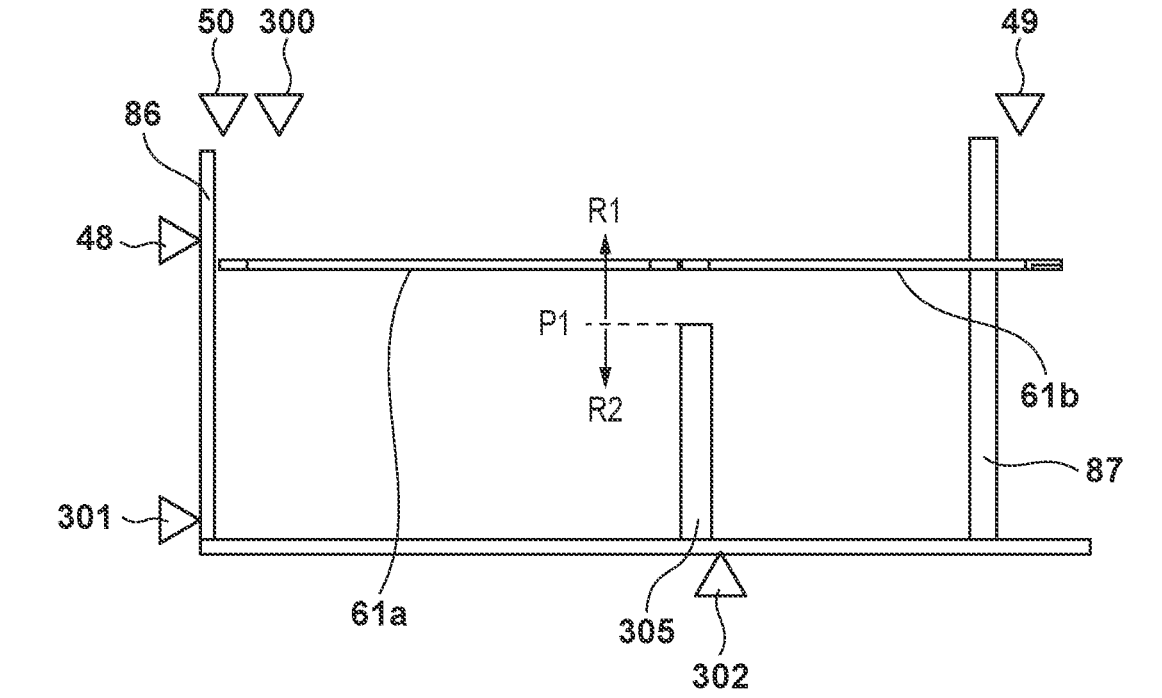

Each of FIGS. 5A and 5B is a side view of the paper feed mechanism 30 for explaining the behavior of the stacking mechanism 61. FIG. 5A shows a structure in a state in which the first stacking unit 61*a* is located in a first region R1 below the position P1, and the second stacking unit 61*b* is fixed to the position P1. In FIG. 5A, the trailing end guide unit 87 is located on the downstream side of the support unit 305 (or on the downstream side of the second stacking unit 61*b*). In this state, the sheets S of the normal size (for example, an A3 or A4 size) can be stacked on the first stacking unit 61*a*.

FIG. 5B shows a structure in a state in which the first stacking unit 61*a* is located in a second region R2 above the position P1, and the second stacking unit 61*b* is jointed to the first stacking unit 61*a*. The trailing end guide unit 87 is located on the upstream side of the support unit 305 (or below the second stacking unit 61*b*). In this state, the sheets S of the large size (for example, a non-standard size longer than the normal size) can be stacked on the first and second stacking units 61*a* and 61*b*.

From a viewpoint of the user, the user can adjust the position of the trailing end guide unit 87 in the b direction, stack the sheets S of the normal size by moving the trailing end guide unit 87 to the downstream side, and stack the sheets S of the large size by moving the trailing end guide unit 87 to the upstream side.

Then, the first stacking unit 61*a* can move up and down using both the first and second regions R1 and R2 as movable regions. On the other hand, the second stacking unit 61*b* is held at the position P1 if the first stacking unit 61*a* is in the first region R1, and can move up and down together with the first stacking unit 61*a* while being jointed to the portion 61*a*' of the first stacking unit 61*a* if the first stacking unit 61*a* is in the second region R2. That is, at the position P1, the second stacking unit 61*b* is jointed to the first stacking unit 61*a* in synchronism with the raising operation of the first stacking unit 61*a*, and released from the joint in synchronism with the lowering operation of the first stacking unit 61*a*. Hence, the position P1 is a position higher than a lower limit position at which the first stacking unit 61*a* can be lowered, and lower than an upper limit position at which the first and second stacking units 61*a* and 61*b* can be raised.

In order to be able to stack the sheets S of the large size in cooperation with the first stacking unit 61*a*, the second stacking unit 61*b* is juxtaposed with a portion of the first stacking unit 61*a* capable of stacking the sheets S of the normal size in the b direction (that is, a direction parallel to the long sides of the sheets S of the large size).

Note that the weight of one sheet S of the large size is heavier than that of the normal size. Then, according to this embodiment, if the sheets S of the normal size are stacked, the lower end of the movable region of the first stacking unit 61*a* is below the position P1. On the other hand, if the sheets S of the large size are stacked, the lower end of the movable region of the first stacking unit 61*a* (and the second stacking unit 61*b*) is at the position P1. Accordingly, the maximum stacking number (for example, 1,500) of sheets S of the large size becomes less than the maximum stacking number (for example, 3,000) of sheets S of the normal size. Therefore, according to this embodiment, an excessive load is not applied to the up-and-down movement motor 55 even if the sheets S of the large size are stacked. Note that the stacking amount of the sheets S of the large size becomes the greatest in a state in which the first and second stacking units 61*a* and 61*b* are fixed to the position P1.

The guide unit detection sensor 302 acts as a detection unit capable of detecting whether the size of the sheets S to be stacked is one of the normal size and the large size depending on the position of the trailing end guide unit 87. Based on a detection result by the guide unit detection sensor 302, the controller 41 can measure the size of each sheet S, for example, can decide the conveyance distance of the sheet S by the pickup roller 51.

Figure 6A:
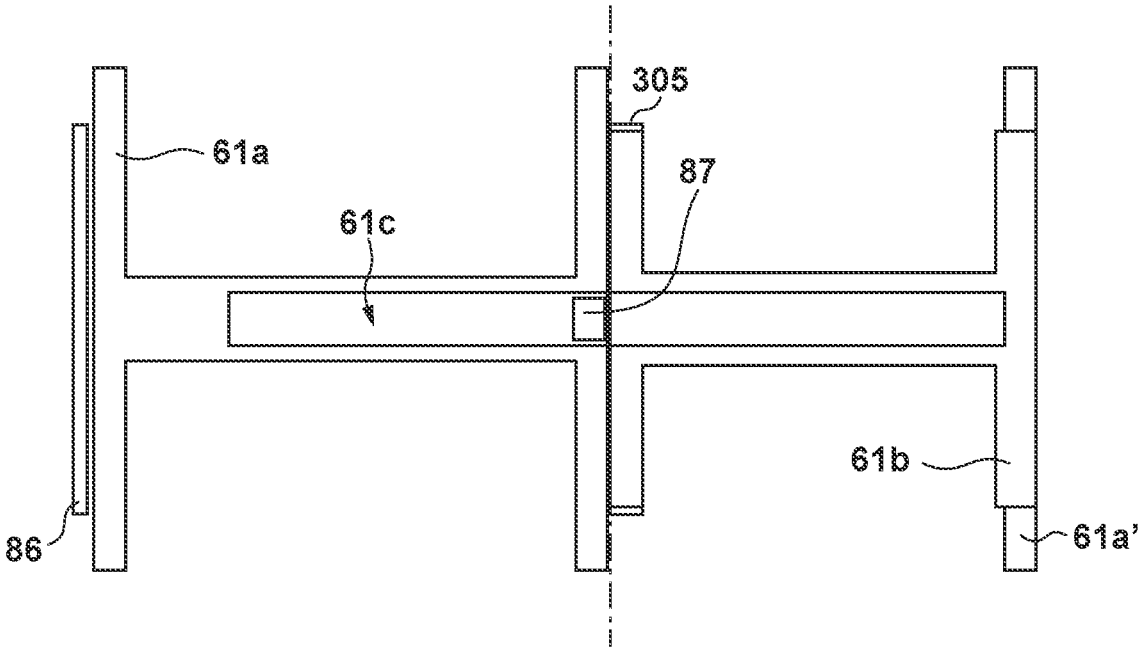
FIGS. 6A and 6B are plan views each for explaining an example of the internal structure of the paper deck.
Figure 6B:
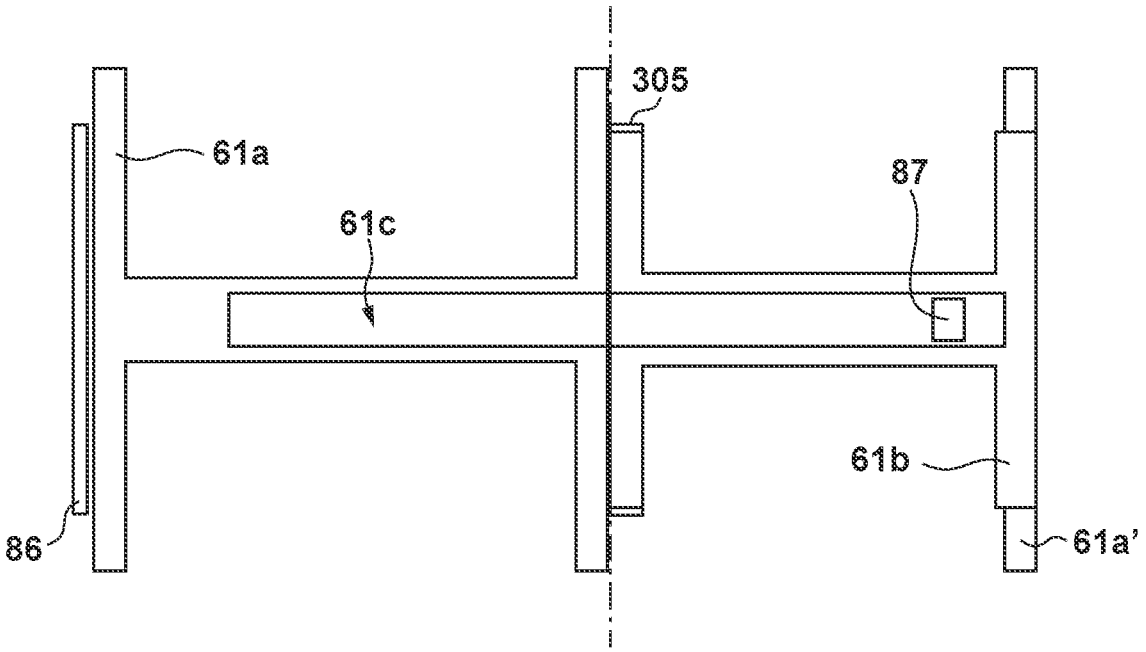

FIG. 6A is a plan view showing the paper feed mechanism 30 corresponding to FIG. 5A. FIG. 6B is a plan view showing the paper feed mechanism 30 corresponding to FIG. 5B. As can be seen in FIGS. 6A and 6B, the stacking mechanism 61 includes an elongated hole portion 61*c* extending in the b direction, and the trailing end guide unit 87 can move in the b direction in the elongated hole portion 61*c*.

Note that the first stacking unit 61*a* has a fence-like shape that includes, in a planar view (in a perspective in the vertical direction), a wide portion extending in the b direction and a plurality of narrow portions extending in the h direction from this wide portion. This allows the side edge guide units 80 and 83 to be arranged apart from the first stacking unit 61*a* in the h direction and to move in the h direction while preventing a deflection of each stacked sheet S. Note that the width of the wide portion in the h direction is wider than the width of each narrow portion in the b direction, and the above-described elongated hole portion 61*c* is provided in this wide portion.

The second stacking unit 61*b* is provided so as to overlap a part of the first stacking unit 61*a* on the upstream side, here the thin portion 61*a*' in the planar view. With this structure, the second stacking unit 61*b* is jointed to the first stacking unit 61*a* when the first stacking unit 61*a* is raised to the position P1, and then can move up and down in the second region R2 above the position P1 together with the first stacking unit 61*a*. Further, the second stacking unit 61*b* has a fence-like shape similar to the first stacking unit 61*a*, allowing the side edge guide units 83 to be arranged apart from the first and second stacking units 61*a* and 61*b* in the h direction, and to move in the h direction.

The above-described elongated hole portion 61*c* is illustrated as one rectangular hole in each of FIGS. 6A and 6B, but is formed to be provided in both the first stacking unit 61*a* and the second stacking unit 61*b*. That is, in the planar view, one hole is provided over both of a portion which overlaps the second stacking unit 61*b* and a portion which does not overlap the second stacking unit 61*b* concerning the first stacking unit 61*a*, and a portion which overlaps the first stacking unit 61*a* concerning the second stacking unit 61*b*. This allows the trailing end guide unit 87 to move in the b direction.

Figure 7A:
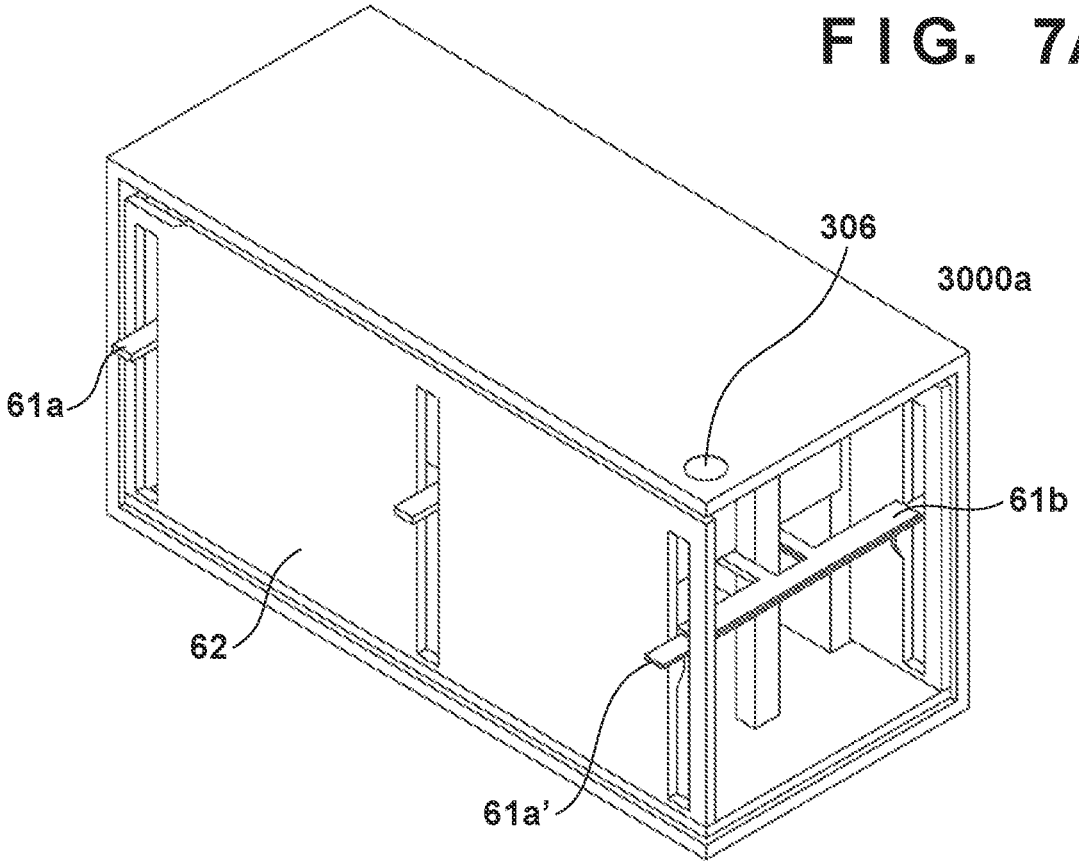
FIGS. 7A and 7B are perspective views each for explaining an example of the internal structure of the paper deck.
Figure 7B:
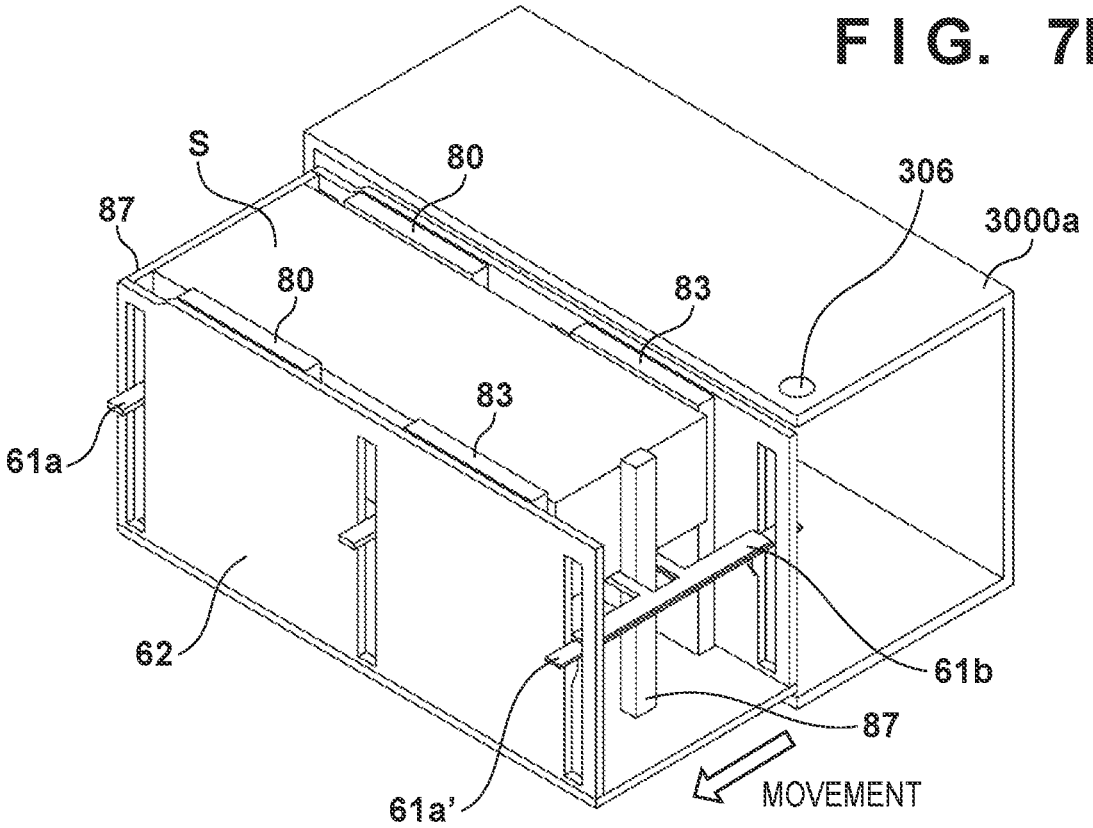

FIGS. 7A and 7B are perspective views each for explaining the internal structure, or mainly the housing 3000*a* and storage 62 of the paper deck 3000. FIG. 7A is the perspective view in a state in which the storage 62 is closed. FIG. 7B is the perspective view in a state in which the storage 62 is opened. As described with reference to FIG. 2, the controller 41 opens the storage 62 in response to pressing of the storage opening/closing button 306 by the user.

Figure 8A:
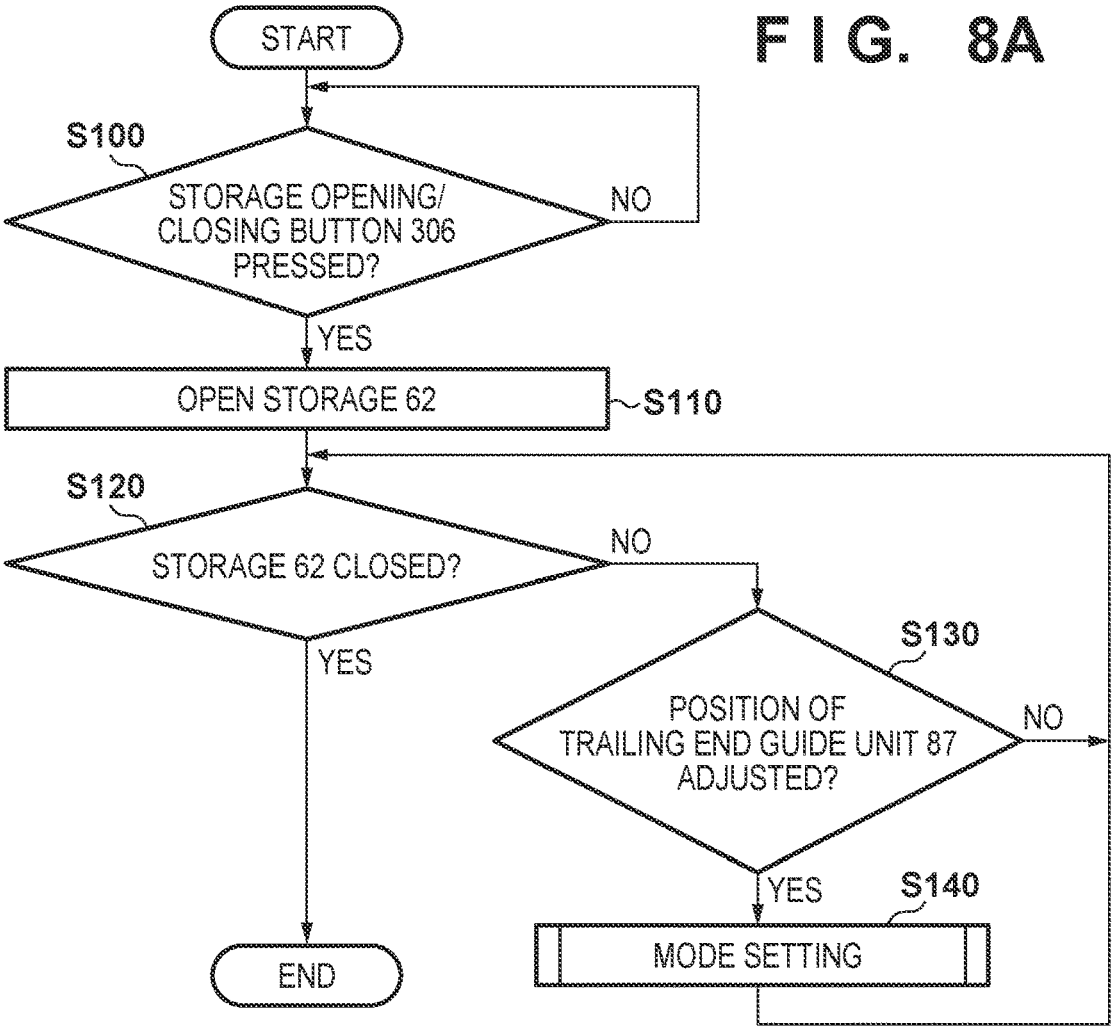
FIGS. 8A and 8B are flowcharts each for explaining a method of using the paper deck.
Figure 8B:
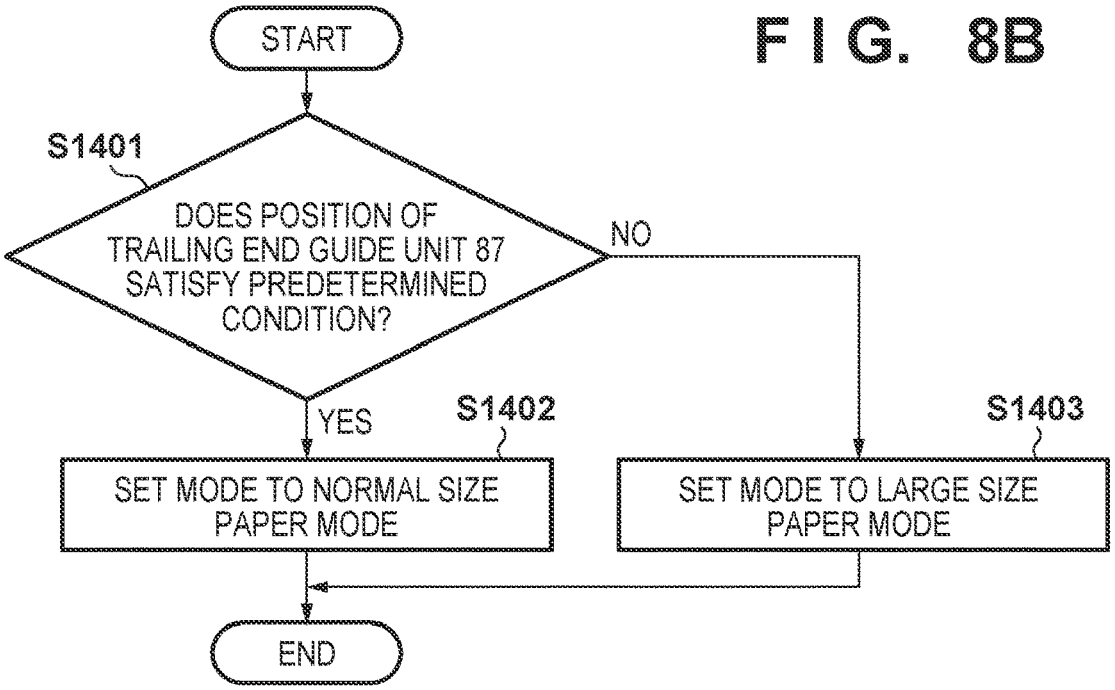

FIGS. 8A and 8B are flowcharts for explaining a method of using the paper deck 3000. Contents of respective steps in these flowcharts are mainly performed by the controller 41. The flowchart of FIG. 8A shows a method of setting the size of the sheet S that can be stored in the storage 62. In this flowchart, the user can set the size of the sheet S by adjusting the position of the trailing end guide unit 87 after the storage 62 is opened.

First, in step S100 (to be simply referred to as "S100" hereinafter, and ditto for other steps), the controller 41 determines whether the storage opening/closing button 306 (see FIG. 2) is pressed. If the button 306 is pressed by, for example, the user, the process advances to S110; otherwise, the process returns to S100. In S110, the controller 41 opens the storage 62 in response to pressing of the button 306.

In S120, the controller 41 determines whether the storage 62 is closed by the user. If the storage 62 is closed by, for example, the user, this flowchart ends; otherwise, the process advances to S130. It is possible to implement S120 by a detection result of the storage opening/closing sensor 49 (see FIG. 2).

In S130, the controller 41 determines whether the position of the trailing end guide unit 87 is changed. If the position of the trailing end guide unit 87 is changed, the process advances to S140; otherwise, the process returns to S120. It is possible to implement S130 based on a detection result of the guide unit detection sensor 302 (see FIGS. 2, 5A, and 5B).

In S140, an operation mode is set based on the change in position of the trailing end guide unit 87, that is, based on the size of the sheet S to be stored or conveyed newly. For example, adjustment of the conveyance distance of the sheet S, or adjustment of the rotation amounts of the pickup roller 51 and roller pair 31 in this embodiment is performed.

The flowchart of FIG. 8B shows an example of a method of setting the operation mode in S140. In S1401, the controller 41 determines whether the position of the trailing end guide unit 87 satisfies a predetermined condition. In this embodiment, the process advances to S1402 if the trailing end guide unit 87 is located on the downstream side of the support unit 305; otherwise, the process advances to S1403.

In S1402, the controller 41 sets the operation mode to a normal size paper mode. If the trailing end guide unit 87 is located on the downstream of the support unit 305, the sheets S of the normal size are stacked on the first stacking unit 61*a* regardless of a joint to the second stacking unit 61*b* (regardless of whether the first stacking unit 61*a* is located in one of the first and second regions R1 and R2). In the normal size paper mode, the first stacking unit 61*a* is lowered to a predetermined position in the first region R1 so as to, for example, make it easier for the user to stack the sheets S of the normal size in the state in which the storage 62 is opened.

In S1403, the controller 41 sets the operation mode to a large size paper mode. If the trailing end guide unit 87 is located on the upstream side of the support unit 305, the movable region of the first stacking unit 61*a* is restricted only to the second region R2. Then, the first stacking unit 61*a* and the second stacking unit 61*b* are jointed to each other, and the sheets S of the large size are stacked on them. In the large size paper mode, the first stacking unit 61*a* is moved to the lower end of the second region R2, that is, the position P1 so as to, for example, make it easier for the user to stack the sheets S of the large size in the state in which the storage 62 is opened.

According to the above control, the user can use the paper deck 3000 appropriately. Referring back to FIG. 3, the side edge guide units 83 may be configured to move to a home position (for example, a position that does not allow the sheets S of the large size to be stacked) in the normal size paper mode (if the trailing end guide unit 87 is located on the downstream side). When the user is about to stack the sheets S of the large size erroneously in the normal size paper mode, the controller 41 may notify the user that the stacking should be stopped by displaying this on the operation panel 40. Further, if the operation mode is changed, the controller 41 may notify the user that the sheets S of a size before the change should be removed from the stacking mechanism 61. These notifications may be made by another notification unit using a sound, light, or the like.

According to this embodiment above, the paper deck 3000 includes the first stacking unit 61*a*, the second stacking unit 61*b* arranged to be jointed to the first stacking unit, and the driving mechanism 54 functioning as the up-and-down movement driving unit. In this embodiment, the sheets S of the normal size can be stacked on the first stacking unit 61*a*. The second stacking unit 61*b* joints to the first stacking unit 61*a*, making it possible to stack the sheets S of the large size together with the first stacking unit 61*a*. The driving mechanism 54 moves up and down the first stacking unit 61*a* in the vertical direction. The second stacking unit 61*b* is fixed to the position P1 if the first stacking unit 61*a* moves up and down in the first region R1 lower than the position P1. On the other hand, the second stacking unit 61*b* joints to the first stacking unit 61*a*, and moves up and down together with the first stacking unit 61*a* if the first stacking unit 61*a* moves up and down in the second region R2 higher than the position P1.

If the sheets S of the normal size are stored in the paper deck 3000, the sheets S of the normal size are stacked on the first stacking unit 61*a*. On the other hand, if the sheets S of the large size are stored in the paper deck 3000, the sheets S of the large size are stacked on the first and second stacking units 61*a* and 61*b* jointed to each other. According to this arrangement, with a comparatively simple arrangement, it becomes possible to move up and down the first stacking unit 61*a* in addition to the second stacking unit 61*b* without providing, for example, the plurality of vertical movement motors 55 of the driving mechanism 54.

In general, the mass of one sheet S of the large size is heavier than the mass of one sheet S of the normal size. Note that the movable region of the second stacking unit 61*b* is above the position P1, that is, the second region R2. Accordingly, the maximum stacking number if the sheets S of the large size are stacked on the first and second stacking units 61*a* and 61*b* is less than the maximum stacking number if the sheets S of the normal size are stacked on the first stacking unit 61*a*. Therefore, the sheets S of the large size are not stored in the paper deck 3000 excessively, and thus the excessive load is not applied to the driving mechanism 54 (for example, the up-and-down movement motor 55).

As another embodiment, a behavior mode of the second stacking unit 61*b* if the first stacking unit 61*a* is in the first region R1 and a behavior mode of the second stacking unit 61*b* if the first stacking unit 61*a* is in the second region R2 may be changed to be reversed. For example, the second stacking unit 61*b* may be held at a predetermined height (for example, the position P1) if the first stacking unit 61*a* is in the second region R2, and may be jointed to the first stacking unit 61*a* and movable up and down together with the first stacking unit 61*a* if the first stacking unit 61*a* is in the first region R1. Such an arrangement can be adopted if the paper feed mechanism 30 is configured to, for example, supply the bundle of the stacked sheets S sequentially from the lowermost sheet to the apparatus main body 900.

Several preferred modes have been described above. However, the present invention is not limited to these examples and may partially be modified without departing from the scope of the invention. In addition, individual terms described in this specification are merely used for the purpose of explaining the present invention, and the present invention is not limited to the strict meanings of the terms and can also incorporate their equivalents.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-114522, filed on Jun. 9, 2017, which is hereby incorporated by reference herein in its entirety.

What is claimed is:

1. A stacking apparatus comprising:

a first stacking unit configured to move up and down between an upper limit position of upward movement and a lower limit position of downward movement, and configured to stack sheets of a first size; and a second stacking unit configured to be jointed to the first stacking unit at a predetermined position in an up-and-down movement direction of the first stacking unit, the second stacking unit being moved up and down together with the first stacking unit while being jointed to the first stacking unit in a case in which the first stacking unit is located between the predetermined position and the upper limit position, and being released from being jointed to the first stacking unit in a case where the first stacking unit is located below the predetermined position, wherein the second stacking unit is configured to stack sheets of a second size larger than the first size in cooperation with the first stacking unit in the range from the predetermined position to the upper limit position.

2. The apparatus according to claim 1, wherein the second stacking unit is jointed to the first stacking unit in synchronism with a raising operation of the first stacking unit and released from being jointed to the first stacking unit in synchronism with a lowering operation of the first stacking unit.

3. The apparatus according to claim 1, wherein the predetermined position is higher than the lower limit position and lower than the upper limit position.

4. The apparatus according to claim 1, wherein the second stacking unit is configured such that its movement to a position lower than the predetermined position is restricted.

5. The apparatus according to claim 1, wherein a step is formed between the first stacking unit and the second stacking unit in a case where the first stacking unit is located at a position lower than the predetermined position.

6. The apparatus according to claim 1, wherein a stacking amount of the sheets of the second size on the first stacking unit and the second stacking unit becomes the greatest in a case in which both the first stacking unit and the second stacking unit are located at the predetermined position.

7. The apparatus according to claim 1, wherein the first stacking unit includes:

a stacking unit configured to stack the sheets of the first size; and a joint unit jointed to the second stacking unit at the predetermined position, wherein the stacking unit and the second stacking unit are juxtaposed in a first direction parallel to long sides of the sheets of the second size.

8. The apparatus according to claim 7, further comprising:

a trailing end guide unit configured to guide an end portion on an upstream side with respect to the first direction of the sheets stacked on the first stacking unit or on the first stacking unit and the second stacking unit, wherein the first stacking unit and the second stacking unit include an elongated hole portion extending in the first direction, and the trailing end guide unit is configured to be movable in the elongated hole portion along the first direction.

9. The apparatus according to claim 8, further comprising:

a detection unit configured to detect a size of the sheets based on a position of the trailing end guide unit in the first direction.

10. The apparatus according to claim 8, further comprising:

a width guide unit configured to guide side edges in a second direction crossing the first direction of the sheets stacked on the first stacking unit or on the first stacking unit and the second stacking unit, wherein the width guide unit is configured to be movable in a partial region of a stacking region of at least one of the first stacking unit and the second stacking unit along the second direction.

11. The apparatus according to claim 10, wherein a movable range of the width guide unit is changed based on a position of the trailing end guide unit in the first direction.

12. The apparatus according to claim 11, wherein the width guide unit is configured to move, in a case where the trailing end guide unit is located in the stacking region of the first stacking unit, to a position where stacking of the sheets of the second size is restricted.

13. The apparatus according to claim 7, further comprising:

an up-and-down movement unit configured to move up and down the first stacking unit, wherein the up-and-down movement unit includes:

a lifting member configured to lift the first stacking unit to a plurality of positions; and a driving unit configured to cause the lifting member to move the first stacking unit up and down by driving.

14. The apparatus according to claim 13, wherein the driving unit is a single motor, and moves the second stacking unit up and down by moving the first stacking unit up and down with the motor in a state in which the first stacking unit and the second stacking unit are jointed to each other.

15. A feeding apparatus comprising:

a first stacking unit configured to move up and down in a vertical direction, and configured to stack sheets of a first size;

a second stacking unit configured to be jointed to the first stacking unit in a state in which the first stacking unit is located at a position of a predetermined height, and configured to stack sheets of a second size larger than the first size in cooperation with the first stacking unit in a state in which the first stacking unit is located at a position even with or higher than the predetermined height, and to be released from being jointed to the first stacking unit in a state in which the first stacking unit is located at a position lower than the predetermined height; and a feeding unit configured to feed the sheets stacked on the first stacking unit or on the first stacking unit and the second stacking unit.

16. The apparatus according to claim 15, wherein the second stacking unit is provided on an upstream side of the first stacking unit with respect to a feeding direction of the feeding unit.

17. An image forming apparatus comprising:

a first stacking unit configured to move up and down in a vertical direction, and configured to stack sheets of a first size;

a second stacking unit configured to be jointed to the first stacking unit in a state in which the first stacking unit is located at a position of a predetermined height, and configured to stack sheets of a second size larger than the first size in cooperation with the first stacking unit in a state in which the first stacking unit is located at a position even with or higher than the predetermined height, and to be released from being jointed to the first stacking unit in a state in which the first stacking unit is located at a position lower than the predetermined height;

a feeding unit configured to feed the sheets stacked on the first stacking unit or on the first stacking unit and the second stacking unit; and an image forming unit configured to form an image on the sheets fed by the feeding unit.

18. A stacking apparatus comprising:

a first stacking unit configured to move up and down between a first upper limit position of upward movement and a first lower limit position of downward movement, and configured to stack sheets of a first size;

a second stacking unit configured to be jointed to the first stacking unit and move up and down together with the first stacking unit between a second upper limit position of upward movement and a second lower limit position of downward movement, and configured to stack sheets of a second size larger than the first size in cooperation with the first stacking unit;

an obtaining unit configured to obtain a size of the stacked sheets;

an up-and-down movement unit configured to move the first stacking unit up and down; and a control unit configured to change a state, by the up-and-down movement unit, from a joint state, in which the first stacking unit and the second stacking unit are jointed to each other, to a release state, in which jointing of the first stacking unit and the second stacking unit is released, in a case in which the size of the sheets obtained by the obtaining unit is the first size, and to change the state from the release state to the joint state in a case in which the size of the sheets obtained by the obtaining unit is the second size, wherein the second lower limit position is above the first lower limit position.

* * * * *